United States Patent [19]

Bush et al.

[11] Patent Number: 5,052,162

[45] Date of Patent: Oct. 1, 1991

[54] ROOFING SHINGLE

[75] Inventors: Arthur B. Bush, Clearwater, Fla.; Dale P. Major, Camden, Ark.

[73] Assignee: The Celotex Corporation, Tampa, Fla.

[21] Appl. No.: 521,622

[22] Filed: May 10, 1990

Related U.S. Application Data

[62] Division of Ser. No. 171,504, Mar. 21, 1988, abandoned.

[51] Int. Cl.[5] ..... E04D 1/00

[52] U.S. Cl. ..... 52/518; 156/260; 156/279

[58] Field of Search ..... 52/518, 557, 558, 553, 52/555, 559

[56] References Cited

U.S. PATENT DOCUMENTS

| | | | |
|---|---|---|---|
| 1,698,891 | 1/1929 | Overbury . | |
| 1,767,374 | 6/1930 | Kirschbraun . | |
| 1,829,886 | 11/1931 | Yates et al. | 156/260 X |
| 3,180,783 | 4/1965 | Walker et al. | 161/93 |
| 3,998,685 | 12/1976 | Czyzewski et al. | 156/260 |
| 4,198,257 | 4/1980 | Pfaff | 156/260 |
| 4,233,100 | 11/1980 | Cunningham et al. | 156/260 |
| 4,717,614 | 1/1988 | Bondoc et al. | 428/143 |
| 4,729,814 | 3/1988 | Jennus | 156/512 |

*Primary Examiner*—David A. Scherbel
*Assistant Examiner*—Creighton Smith
*Attorney, Agent, or Firm*—Charles W. Vanecek

[57] ABSTRACT

This invention provides a process which automatically and in a continuous and uninterrupted manner makes a roofing shingle by applying granules to the top surface of an asphalt impregnated glass mat, laminating a narrow strip of bituminous coated glass mat to the bottom side of a coated glass mat, said narrow strip being cut from said impregnated glass mat and being inverted before said laminating step and cutting the laminated product to produce a laminate having cut-out areas between the remaining tabs. The final shingle is made from a single glass mat which is processed into a two level shingle, each level being made of a portion of the original glass mat with each level having exposed granules.

4 Claims, 2 Drawing Sheets

ROOFING SHINGLE'

This is a division of application Ser. No. 07/171,504, filed Mar. 21, 1988, now abandoned.

BACKGROUND OF THE INVENTION

1. Field of the Invention:

This invention pertains to the field of roofing shingles.

2. Description of the Prior Art:

Roofing shingles have been made in a continuous process in which the apparatus unrolled a felted sheet and immersed the sheet into a bath of bituminous material to saturate the sheet. The saturated sheet then was coated with a bituminous coating adhesive spread over its top and bottom surfaces. Slate roofing granules were applied to its top surface and a fine powder or sand was applied to the bottom surface. The shingle was then cut into a conventional size of 12 inches by 36 inches for packaging.

A more recent development which is thought to enhance the appearance of the finished shingle roof comprises a two-layer shingle in which a narrow strip of asphalt saturated felt is adhered along the exposed edge of the shingle to give the roof an improved appearance by presenting to the viewer's eye a thicker edge for the shingle. However, the laminating was accomplished by cutting shingles of two different widths at different times on the roofing machine and then in a hand operation laminating the narrower strip to the underside of the wider or conventional size shingle. The extra operation has proved to be cumbersome and the additional conveying and handling apparatus costly and space consuming. The extra laminating operation also presented problems in exactly aligning the two exposed edges of the laminates and achieving good adhesion.

More recent technology comprises a roofing shingle which has a broad central area and a narrow strip adhered thereto along one edge of the central area. This roofing shingle has cut-out areas along the edge of the central strip and in the adhered narrow strip. The process for making this improved shingle is described and claimed in U.S. Pat. No. 3,998,685, entitled: APPARATUS AND PROCESS FOR MAKING AN OFFSET LAMINATED ROOFING SHINGLE AND ROOFING SHINGLE MADE THEREBY and assigned to The Celotex Corporation.

Recently, the organic felted material of which the roofing shingle used to be made has been changed to a glass fiber mat which is fire retardant. It is no longer necessary to saturate the glass mat in a bath of asphalt or bitumen. The glass mat is merely coated with an asphalt layer which also easily penetrates into the mat itself.

A newer development is a shingle which has a broad central area and a narrow strip adhered along one edge of the central area. The combination shingle has tabs between cut out areas along the edge which has the double layer of a wide central area and narrow strip as described in the cited patent. A third layer which is a narrow strip of the same material is adhered to the tabs to form a layer underlying and bridging the gaps which separate the tabs.

Among the laminated shingles presently available is one which comprises a generally rectangular main body forming a major central area with a coating of granules on one face and a narrow strip adhered to the side of the central area which is devoid of granules. The narrow strip is secured along one edge of the main body and has granules on its exposed face. A series of tabs between cut-away areas lie along the common edge of the main body and the narrow strip.

SUMMARY OF THE INVENTION

This invention provides a process and apparatus which automatically and in a continuous and uninterrupted manner laminates a narrow strip of bituminous coated glass mat having granules on one face to the bottom side of a coated glass mat with the granules exposed and cuts the laminated product to produce a laminate having cut-out areas between remaining tabs.

The process begins with a single sheet coated with asphalt on one face of which is applied a coating of granules and from which is cut a narrow strip or band. The narrow strip is inverted and then adhered along the center of the uncoated side of the main sheet. The narrow strip has exposed granules on its outer face with no granules in the bonded area between the plain sheet and the narrow strip. A cutting wheel severs the combined sheet into preselected lengths and at the same time cuts along the centerline of the combined sheet to form individual tabs along that edge. The final shingle is made from a single glass mat which is processed into a two level shingle, each level being made of a portion of the original glass mat. This two-level roofing shingle having exposed granules on each side is believed to be more aesthetically attractive than previous roofing shingles because it gives the appearance of having a thicker butt edge than previous shingles.

It has been found that the process for laminating the main sheet and the narrow strip is improved if there are no granules in the area between the main sheet and the narrow strip. As the combined main sheet and narrow strip run together over a laminating roll and a cutting roll, they do not tend to shift with respect to each other as they might do if granules were in the adhesive layer between the sheet and the narrow strip.

It is an object of the present invention to provide a novel apparatus for making a laminated roofing shingle in a continuous operation.

It is a further object of the invention to provide a novel apparatus which produces a laminated roofing shingle with a minimum of hand labor.

It is still another object of the present invention to provide a novel roof shingle.

It is yet another object of the invention to provide a novel process for making a novel laminated roofing shingle in a continuous manner.

Other features and objects of the present invention will become apparent to those skilled in the art when the present description is considered in the light of the accompanying drawings in which like numerals indicate like elements and in which.

Figure 1:
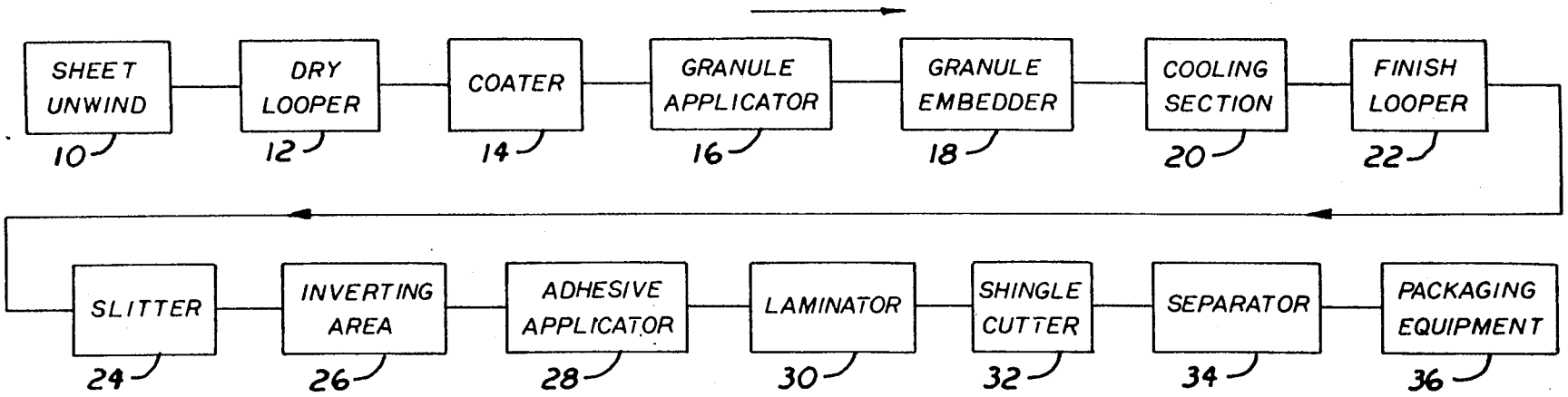
FIG. 1 is a flow diagram useful in explaining the novel process of manufacturing the novel roofing shingle of the invention.

Referring now to the drawings and more specifically to FIG. 1 thereof, there is shown a flow diagram of the novel process of laminating and cutting the laminated sheet to produce a novel roofing shingle. It will be recognized that many of the basic steps of manufacture of the shingle are conventional and are carried out by well-known standard apparatus to be found in any roofing plant. The invention resides in the novel process, the arrangement of the elements of the apparatus and in the final product, the roofing shingle per se.

Hence, in order to avoid undue complexity and to describe the invention in as concise and complete a fashion as possible, the individual pieces of apparatus such as conventional electric motors, bearings, shafts, rolls, conveyors, frames, nuts, bolts, etc., have not been described.

The process may be described by observing the flow sheet of FIG. 1 and following the arrow which represents the sheet in its initial condition as a glass fiber mat in the form of a roll and as it continues to become the finished shingle.

The initial sheet is most generally a mat of suitable glass fibers of approximately 12–26 pounds per 1,000 square feet. For purposes of this invention, the sheet will preferably be 31 inches in width, or multiples thereof, although other widths can be chosen without departing from the scope of the invention. The sheet, as supplied by the manufacturer, is wound on a mandrel or core which is suspended on a bracket to permit unwinding of the sheet. The sheet unwind station is indicated by the numeral 10.

The glass fiber sheet is fed into a dry looper 12 which controls the flow of the sheet as it is unwound from sheet unwind 10 and is fed into a coater 14.

Coater 14 applies a coating of asphalt over and into the glass fiber sheet. Following the coater 14, roofing granules are dropped onto the upper surface of the glass fiber sheet at a granule applicator 16. A granule embedder 18 presses the granules into the surface asphalt coating of the glass fiber sheet. The glass fiber sheet is cooled in cooling section 20 where the asphalt hardens. The glass fiber sheet enters a finish looper 22 which controls the flow of the sheet between the cooling section 20 and the slitter 24. Slitter 24 cuts a shim or band from one edge of the glass fiber sheet. In the present example, the strip is 7 inches wide, leaving the main glass fiber sheet with a width of 24 inches.

The main glass fiber sheet and the strip are separated and the main sheet moves over an adhesive applicator 28 which applies a coating of adhesive over the under surface of the main sheet. The strip is inverted so that its granule-faced surface is facing downwardly and the surface without granules is facing the undersurface of the main sheet. The strip is shifted so that its centerline is aligned with the centerline of the main sheet. The two sheets are run over a laminator 30 which forces the back surface of the strip against the undersurface of the main sheet. A shingle cutter 32 cuts the combined main sheet and strip so that tabs and cut-out portions are made along the central area of the combined sheet and strip. At the same time the combined sheet and strip is cut into lengths of 40 inches to form a roofing shingle with exposed granules on the upper face of the main sheet and the exposed face of the strip. After shingle cutter 32 has cut the combined sheet, the two parts of the sheet are separated by being placed on spaced conveyers 34.

Suitable standard packaging apparatus 36 may be used to collect, package and wrap the finished roofing shingles for storage.

Figure 2:
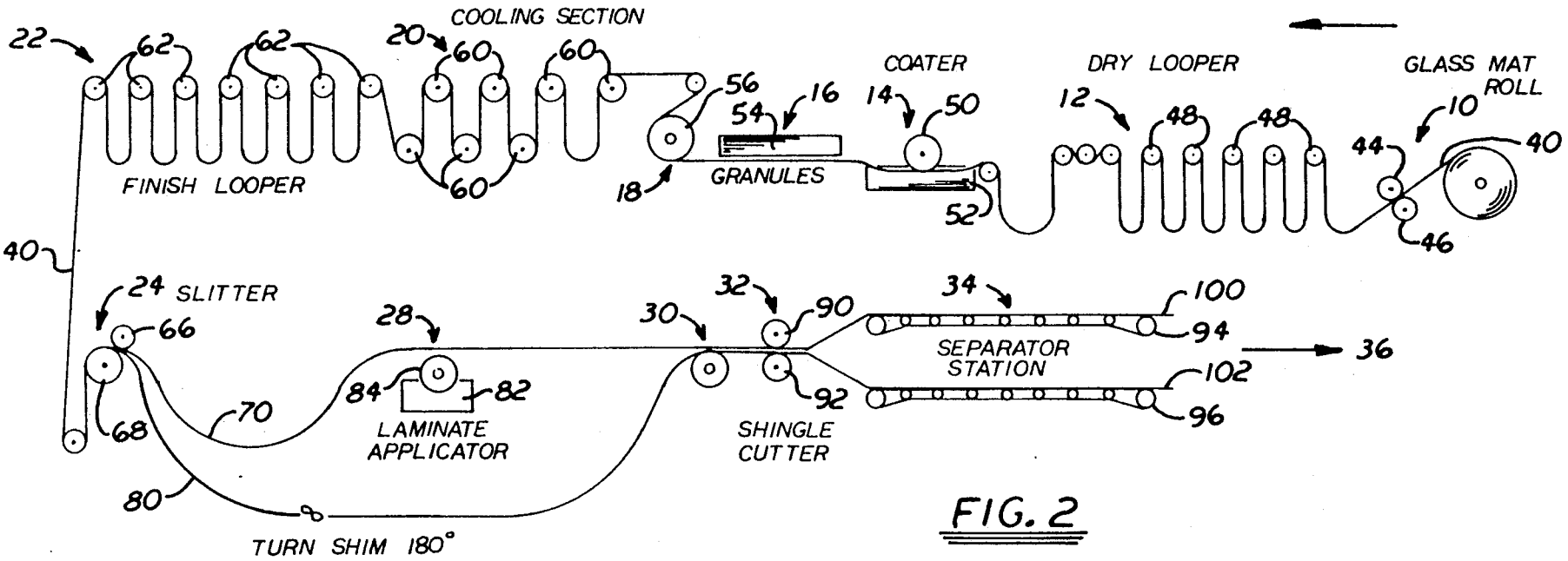
FIG. 2 is a simplified elevational view of the novel apparatus of the invention.

Having described the process with the flow diagram, reference may now be made to FIG. 2, for a more detailed description of the apparatus. For purposes of simplifying the description, the apparatus for handling, unwinding the sheet and coating the sheet, will not be described since these are conventional and well-known pieces of equipment. Also the parts of the apparatus shown in block diagram form in FIG. 1 will be designated generally by the same numerals in FIG. 2.

Starting at the right-hand edge of FIG. 2, glass mat 40 is pulled by rolls 44 and 46 from the sheet unwind unit 10.

From the nip of rolls 44 and 46, the glass fiber sheet which is 31 inches wide is fed into a dry looper which consists of a series of rolls 48 over which the glass fiber sheet is draped. The dry looper permits control over the speed at which the sheet is fed into the coater 14.

Coater 14 comprises a coating wheel 50 which dips into a tray 52 containing asphalt. Glass fiber sheet 40 runs below wheel 50 and asphalt from tray 52 penetrates the sheet.

Sheet 40 is then fed underneath a granule applicator 54 which applies granules to the upper surface of sheet 40. Granule embedding drum 56 around which sheet 40 runs presses the granules into the asphalt coating of sheet 40.

To cool the hot asphalt into which the granules have been embedded, sheet 40 is fed into a cooling section 20 which is a series of rolls 60 around which sheet 40 is looped.

At the finish looper station 22, sheet 40 is fed over a series of rolls 62 which controls the speed of sheet 40 as it enters the slitter 24. Slitter 24 comprises an upper cutting wheel 66 and an anvil roll 68 upon which sheet 40 is cut lengthwise to form a main sheet 70 having a width of 24 inches and a strip 80 having a width of 7 inches. At this point both the main sheet 70 and the strip 80 having granules embedded on their respective upper surfaces.

The main sheet 70 is fed over a back coater 28 which comprises a tray 82 which contains asphalt and a drum 84, the lower surface of which rotates in the asphalt in tray 82. Drum 84 applies asphalt from tray 82 to the central area of the back side of main sheet 70 to form an adhesive coating about 7 inches wide to receive strip 80.

Strip 80 is turned over 180° so that its back without granules is now facing upwardly. The centerline of strip 80 is aligned with the centerline of main sheet 70. Strip 80 is pressed against the asphalt coated underside of main sheet 70 to be adhered thereto.

The combined main sheet 70 and strip 80 are fed into a shingle cutter 32 which comprises an upper cutting wheel 90 and a lower anvil roll 92. The cutting wheel 90 has cutting knives secured to its other periphery such that the combined sheet is cut into lengths of 40 inches and the centerline of the combined sheet is cut into two pieces having alternating tabs and cut out spaces as shown in FIG. 3.

Figure 4:
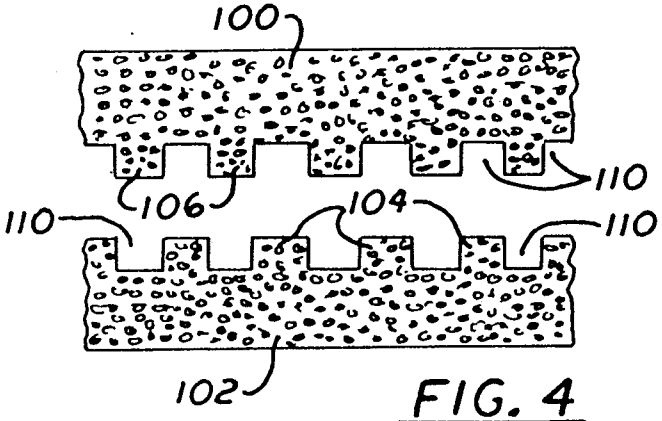
FIG. 4 is a top view of the separated sheets after cutting an through a separator.

The cut combined sheet is separated into two parts 100 and 102 as shown in FIG. 4 at separator station 34 by conveyors 94 and 96.

Figure 3:
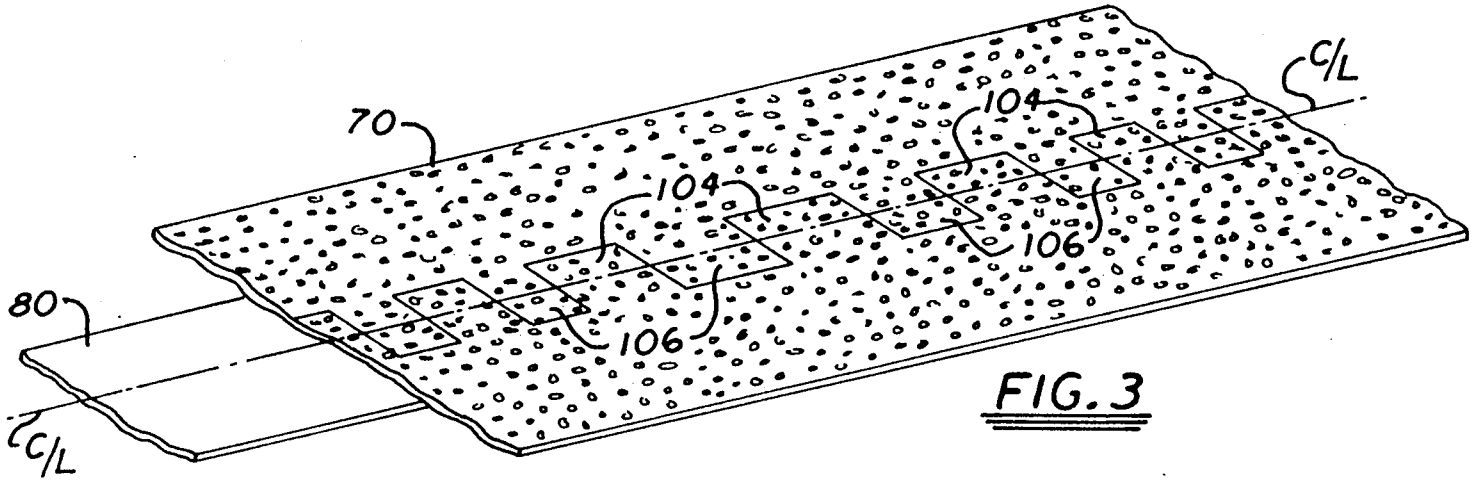
FIG. 3 is a perspective view of the top and bottom sheets laminated together after passing through a cutter press.

Referring now to FIG. 3 strip 80 is shown aligned with the centerline of main sheet 70 and the cut performed at cutting station 22 is shown as an angularly offset line forming tabs 104 and 106.

FIG. 4 shows the two separated pieces of the combined main sheet 70 and strip 70 in a top elevational view with tabs 104 and 106 clearly shown and cut-out spaces 110 shown between the tabs.

Figure 5:
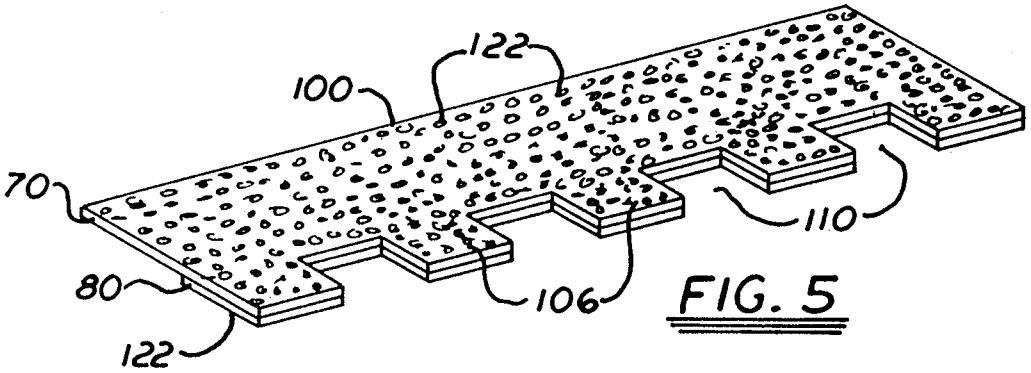
FIG. 5 is a perspective view of the novel roofing shingle of the invention.

FIG. 5 shows a perspective view of the final shingle 100 with the upper main sheet 70 having granules 122 on top and a strip 80 adhered along one edge thereof. Strip 80 has exposed granules on its side facing downwardly.

In order to show that much of the general machinery and process is well known to those skilled in the art, it is intended to incorporate in this disclosure the following publication.

"Manufacture, Selection, and Application of Asphalt Roofing and Siding Products" by N. L. Strahan and published by Asphalt Roofing Manufacturers Association of 757 Third Avenue, New York, N.Y. 10017, copyrighted, 1966.

In summary there has been disclosed an apparatus, and process for making a novel roofing shingle by cutting a single web having granules on its upper surface into two parts, laminating the two parts with coincident centerlines, such that the combined sheet has granules exposed on each face, cutting the laminated sheet into two strips with interdigitating tabs, separating the two strips and cutting the strips into roofing shingles. The novel apparatus and the novel roofing shingle are described.

While the present invention has been described with respect to specific embodiments thereof, it should be understood that the invention is not limited thereto as many modifications thereof can be made. It is, therefore, contemplated to cover by the present application any and all such modifications as fall within the spirit and scope of the appended claims.

We claim:

1. A roofing shingle comprising a top asphalt coated sheet, a second asphalt coated sheet, adhesive means between said sheets to secure said sheets together to form a two-layered, laminated sheet, said second sheet being equal in length to said top sheet but being substantially narrower than said top sheet and having one edge of said second sheet in alignment with one edge of said top sheet, said laminated sheet having alternating tabs and cut-out portions along one edge thereof, said top sheet and said second sheet having granules embedded on opposite facing sides of said roofing shingle.

2. A roofing shingle as recited in claim 1 in which the aligned edges of said laminated sheet comprises a series of outwardly extending tabs and in which the opposite edge of said laminated sheet comprises only said top sheet in a straight line.

3. A roofing shingle as recited in claim 1 in which each of the top asphalt coated sheet and the second asphalt coated sheet comprises a glass mat.

4. A roofing shingle as recited in claim 2 in which each of the top asphalt coated sheet and the second asphalt coated sheet comprises a glass mat.

* * * * *